US006419105B1

(12) United States Patent
Bruce et al.

(10) Patent No.: US 6,419,105 B1
(45) Date of Patent: Jul. 16, 2002

(54) SPILL RESISTANT LID WITH OPENABLE AND CLOSEABLE DRINKING OPENING

(75) Inventors: Robert Bruce, Buchanan; Robert C. Warrer, Paris, both of TN (US)

(73) Assignee: Bruce-Warrer Development Corporation, Buchanan, TN (US)

( * ) Notice: Subject to any disclaimer, the term of this patent is extended or adjusted under 35 U.S.C. 154(b) by 0 days.

(21) Appl. No.: 09/671,027

(22) Filed: Sep. 26, 2000

(51) Int. Cl.[7] ..... A65D 41/32

(52) U.S. Cl. ..... 220/266; 220/268; 220/712; 220/713

(58) Field of Search ..... 220/266, 268, 220/703, 712, 713, 714, 254; 222/541.5, 541.6, 517, 498

(56) References Cited

U.S. PATENT DOCUMENTS 3,868,043 A * 2/1975 Freemyer ..... 220/90.4
4,210,256 A 7/1980 Amberg et al.
4,350,260 A 9/1982 Prueher
4,441,623 A 4/1984 Antoniak
4,503,992 A 3/1985 Sitko et al.
4,589,569 A * 5/1986 Clements ..... 220/90.2
4,925,051 A * 5/1990 Herbst ..... 220/90.4
4,986,437 A 1/1991 Farmer
5,050,758 A * 9/1991 Freeman et al. ..... 220/90.4
5,143,248 A * 9/1992 Sawatsky ..... 220/711

* cited by examiner

*Primary Examiner*—Lee Young
*Assistant Examiner*—Lien Ngo
(74) *Attorney, Agent, or Firm*—Mallinckrodt & Mallinckrodt; Robert R. Mallinckrodt

(57) ABSTRACT

A spill resistant lid to be secured over the open top of a container to resist spilling of the container contents from the open top of the container includes a central lid portion extending over the open top of the container. A raised portion, such as a drinking mouthpiece, extends above the central lid portion and a deformable section, such as a cylindrical section, extends downwardly from the raised portion toward the central lid portion. The deformable section is at least partially separable from the central lid portion so it can be deformed in an over center manner or other manner such that deformation of the deformable section toward the raised portion results in the deformable section assuming a stable open position exposing an opening or hole through the lid into the container and deformation of the deformable section from open position results in the deformable section assuming a stable closed position over the opening or hole.

17 Claims, 3 Drawing Sheets

SPILL RESISTANT LID WITH OPENABLE AND CLOSEABLE DRINKING OPENING

BACKGROUND OF THE INVENTION

1. Field

Figure 7:
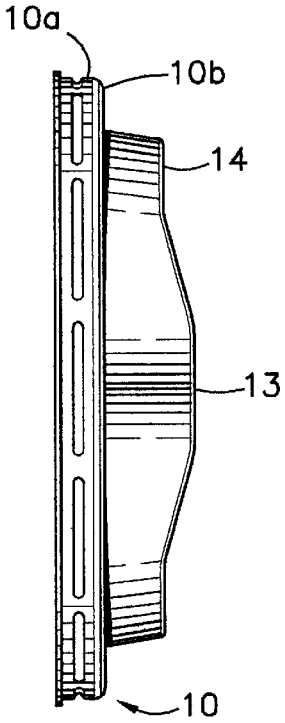

The invention is in the field of spill resistant lids or caps for containers such as beverage cups or glasses.

2. State of the Art

There are various lids or caps currently available to place on and over the top of coffee and soft drink cups and glasses and other liquid containers, such as soup cups, to help keep the contents of the cup or glass from spilling as the cup or glass is carried by the user or is carried in vehicles such as cars. A common type of lid is a disposable lid made of thin plastic material which is snapped onto the top of paper or plastic soft drink or hot drink cups or other containers at fast food restaurants. Most such lids have an access or drinking hole through which a straw can pass for drinking or an access or drinking hole through which the contents can pass when the cup, glass, or other container is tipped by the user so the user can drink directly from the cup, glass, or other container. For some containers, such as soup cups containing soup having chunks of material therein, such as meat or vegetable chunks, a larger hole than that normally required for drinking a beverage is usually preferred so the chunks can pass therethrough. The larger the hole in the lid, however, the more the chance of spillage by the liquid in the container splashing through the hole.

U.S. Pat. Nos. 4,210,256, 4,441,623, and 4,350,260 show lids with closed access or drinking holes of various configurations which can be pushed open by a user when the user desires to drink from the cup. The holes close again when the user stops pushing, thereby requiring continuing effort and affirmative action by the user to open and keep the drinking hole open when drinking or otherwise discharging the contents from the container.

SUMMARY OF THE INVENTION

The present invention provides an access or drinking hole or opening in a spill resistant lid which can be easily opened when a user wants to drink or have other access to the contents of the container and closed when the user wants the hole closed. When opened, the drinking hole will remain open without being held open by the user until it is closed by action of the user to close the hole. The lid includes a central lid portion or surface which covers the container opening and a spout or mouthpiece which rises above the lid surface and is aligned with the drinking hole. A deformable section, such as a cylindrical section, runs from the mouthpiece toward the central lid portion, preferably substantially diagonally inwardly and downwardly from the mouthpiece to the central lid portion. The deformable section is separable with respect to the central lid portion so the deformable section can be inverted toward the mouthpiece to create a drinking opening or hole in the lid to provide access to the inside of the covered container. The inverted deformable section, when inverted, is restrained against the mouthpiece just over center of the deformable section deformation so stays in open position. A small deflection on the mouthpiece toward the central portion will deflect the deformable section back over center and it will snap into closed position again. Thus, when desired to close the drinking opening or hole, the deformable section is deflected slightly inwardly away from the mouthpiece and it will snap back to its original position over the hole thereby closing the hole.

The deformable section will generally extend from the raised portion to the lid surface where it is cut at the intersection with the lid surface, either as part of the manufacturing process or by the user based upon a perforated or scored line at the intersection provided as part of the manufacturing process, to separate it from the lid surface. This cut allows the deformable section to then be deformed over center toward the mouthpiece so that it remains in open position. Moving the deformable section opens a hole in the lid surface. Alternately, the cut can be made above the lid surface so that the deformable section is that which extends from the mouthpiece to the cut. An extension from the lid surface is formed extending from the lid surface to the cut.

Rather than providing a mouthpiece toward the edge of the lid, the deformable section can extend from a raised portion of the lid located as desired on the lid, such as at the center of the lid.

DRAWINGS

Figure 1:
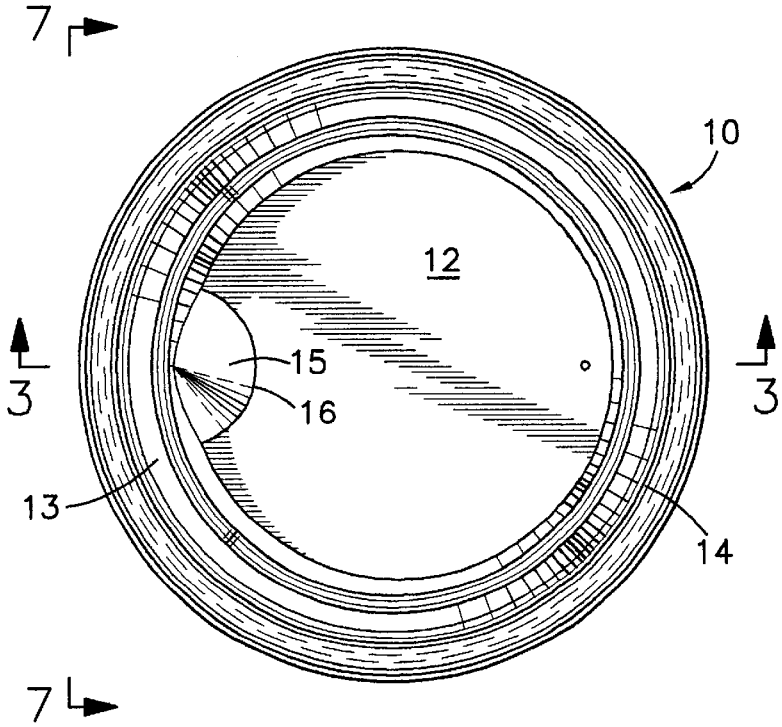
Figure 2:
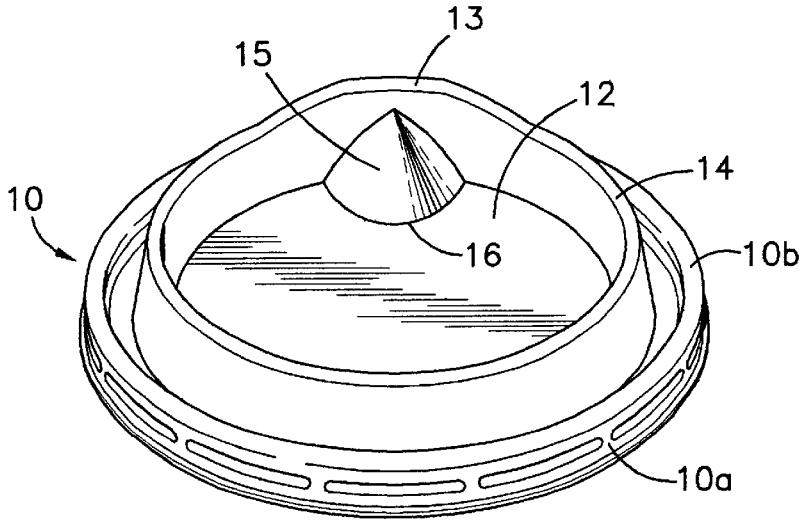
Figure 3:
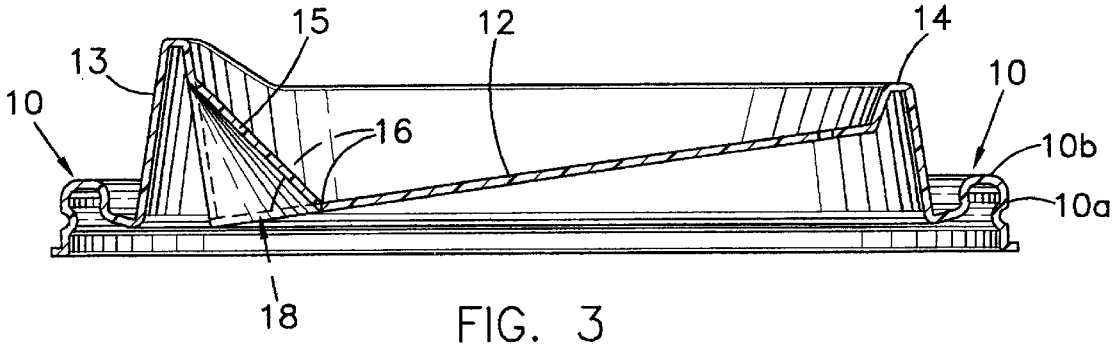
Figure 6:
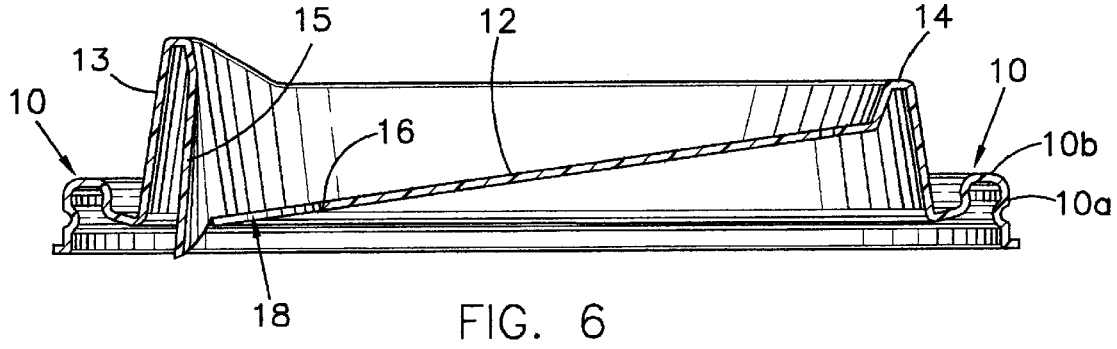
Figure 8:
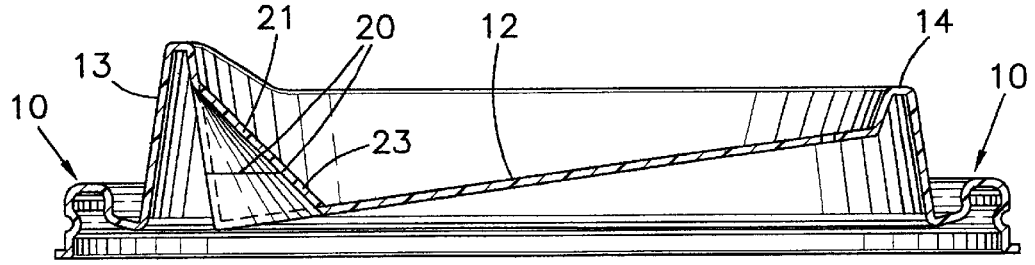
Figure 9:
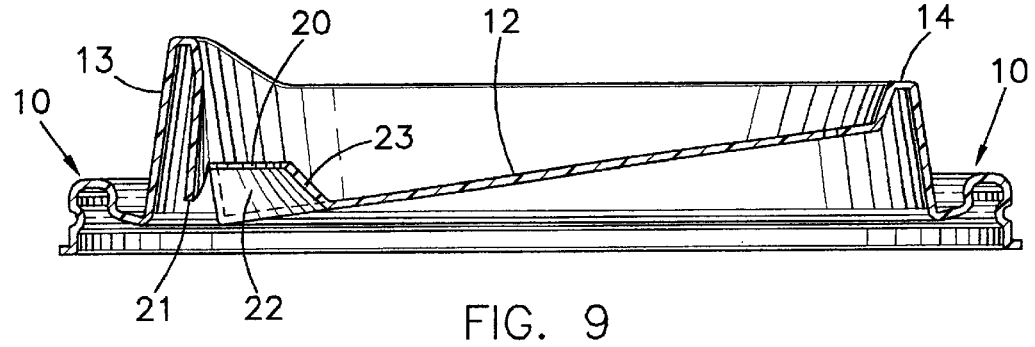
Figure 4:
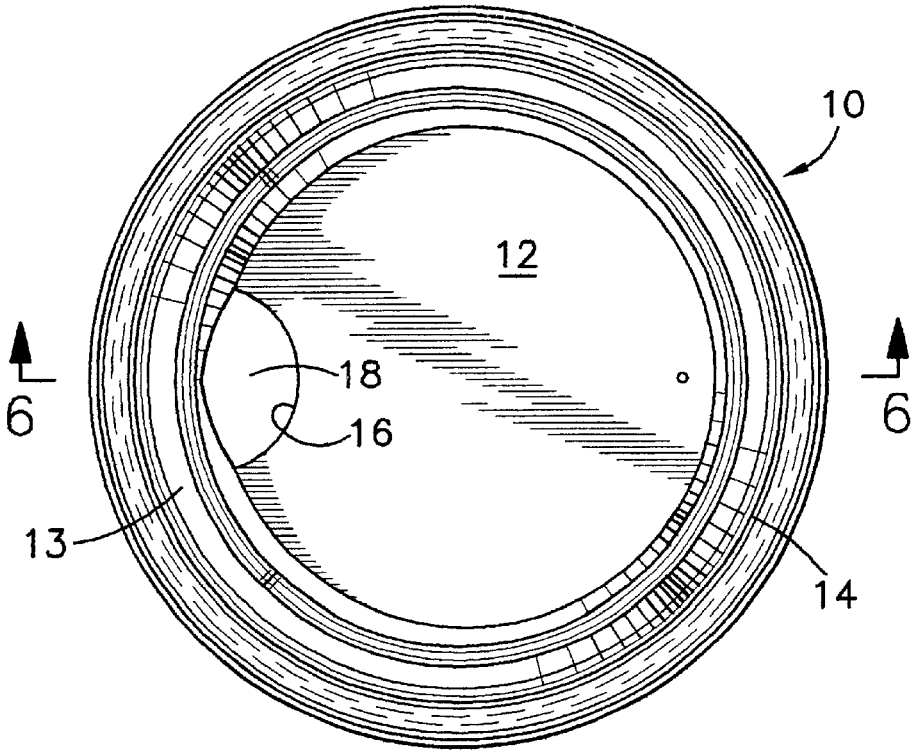
Figure 5:
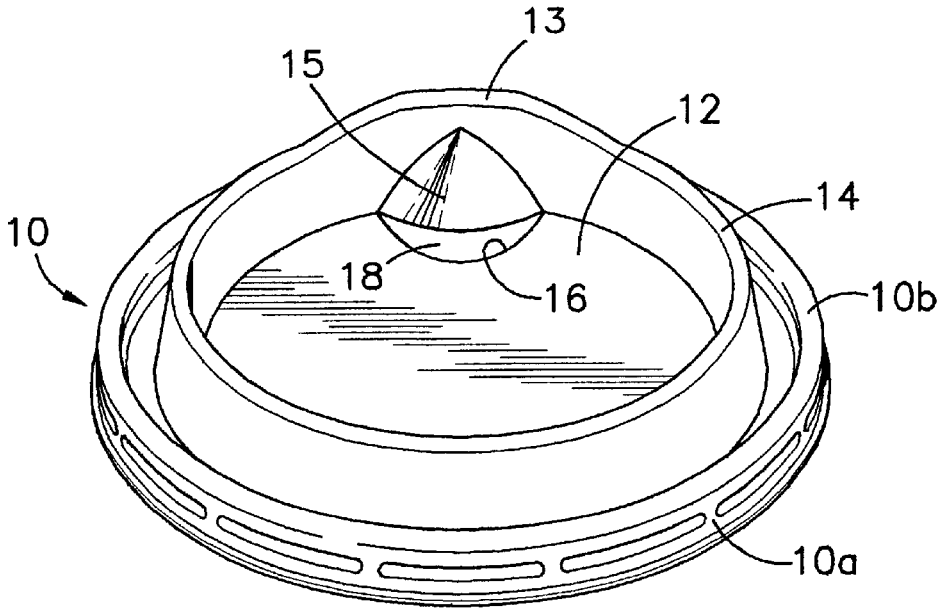

The best mode currently contemplated for carrying out the invention is shown in the accompanying drawings, in which:

FIG. 1 is a top plan view of a lid of the invention showing the lid opening in closed position;

FIG. 2, a top rear pictorial view of the lid of FIG. 1;

FIG. 3, a vertical section of the lid taken on the line 3—3 of FIG. 1;

FIG. 4, a top plan view of the lid of FIG. 1, but showing the opening in open position;

FIG. 5, a top rear pictorial view similar to that of FIG. 2, but showing the opening in open position as in FIG. 1;

FIG. 6, a vertical section of the lid taken on the line 6—6 of FIG. 3;

FIG. 7, a front view of the lid taken on the line 7—7 of FIG. 1;

FIG. 8, a view similar to that of FIG. 3, showing a slightly different embodiment of the invention; and FIG. 9, a view similar to that of FIG. 6, showing the embodiment of FIG. 8 in open position

DETAILED DESCRIPTION OF THE ILLUSTRATED EMBODIMENT

The spill resistant lid of the invention includes a circumferential securing means 10 which fits over and secures the lid to the walls of a container such as a disposable plastic or paper cup as commonly used for hot beverages such as coffee or soup or cold beverages such as soft drinks. Any type of securing means can be used and the are many currently in use. The securing means is meant to include any type of lid securement currently known or developed in the future. Its function is to secure the lid to the container. In general, the securement means shown includes an outer circumferential wall 10*a,* FIGS. 2 and 3, which, together with a top wall 10*b,* forms a container wall receiving and holding area in which the container wall surrounding the container opening is received when the lid is positioned on the container. A currently preferred securing means is that shown and described in copending application Ser. No. 09/585,689, because it also provides a good seal with the container wall.

The lid also includes a central lid portion 12 positioned inside the securing means 10 over the container opening when the lid is secured over the container. A spout or mouthpiece 13 extends above the level of the central lid portion and may be part of a circumferential wall 14 extending around the central lid portion, which, with the central lid portion 12 which is shown sloped in respect to the container opening it covers, forms a reservoir to catch, hold, and funnel back into the container any container contents that may splash out of a drinking or access hole in the central lid portion of the lid.

A deformable section 15 extends from mouthpiece 13 inwardly and downwardly to the central lid portion 12. The deformable section 15 is separable from the central lid portion 12 to allow the deformable section to be deformed by pushing it toward the mouthpiece 13. This will cause the deformable section 15 to pass through a center point after which it will be biased in a direction toward the mouthpiece rather than toward the center of the lid. Thus, the deformable section will move over center and rest against and be restrained by the mouthpiece 13 as shown in FIGS. 4–6. This opens a hole 18 in the central lid portion through which the contents of the covered container can be drunk or otherwise discharged. The separability may be provided by a cut 16 along the intersection of the deformable section 15 and central lid portion 12. This cut may be made during manufacture of the lid, or the desired cut line may be perforated or scored so the user can separate the deformable section from the central lid portion by breaking the score or perforations to form the cut.

With this arrangement, when in open position, a small deformation of the deformable section back toward the center of the lid will push the deformable section back over center and it will snap back to closed position shown in FIGS. 1–3. This small deflection back over center can be accomplished by a small deflection on the mouthpiece 13 which can be accomplished by the lower lip of a user drinking from the cup or by force exerted by a user's tongue or finger. Thus, the opening 18 can be easily opened and closed by a user as desired by the user. The deformable section 15 will remain in either the open or closed position until moved by the user.

It has been found that a cylindrical section works well as the deformable section 15 with the cylindrical section extending diagonally downwardly and inwardly from the mouthpiece as shown in FIG. 3. While shown as extending from a raised mouthpiece 13, a raised section could be provided interiorly of the central lid portion and the deformable section could extend outwardly and downwardly toward the user. This would be workable, but not as convenient as the embodiment shown.

While the cut, perforations, or score line 16 in FIGS. 1–6 is shown at the intersection of the deformable section 15 and the central lid portion 12, the cut, perforation, or score line could be made above the central lid portion 12. Thus, as shown in FIGS. 8 and 9, a cut, perforation, or score line to result in a cut 20, is positioned above central lid portion 12 in the area of the deformable section. The deformable section 21 then extends from mouthpiece 13 downwardly to cut 20. This deformable section 21, when deformed by pushing it over center toward mouthpiece 13, will open hole 22. An extension 23 extends from central lid portion 12 to cut 20 and the top of the extension 23 at cut 20 defines the hole or opening 22. The position of cut 20 above the lid portion 12 in the area of the deformable section 21 and extension 23 will determine the size of the opening or hole 22.

While the invention has been shown with a particular configuration of lid, various lid configurations could incorporate the deformable section to create the openable and closable drinking opening of the invention.

Whereas this invention is here illustrated and described with reference to an embodiment thereof presently contemplated as the best mode of carrying out the invention in actual practice, it should be realized that various changes may be made in adapting the invention to different embodiments without departing from the broader inventive concepts disclosed herein and comprehended by the claims that follow.

What is claimed is:

1. A spill resistant lid adapted to be removably and sealably attached to an open topped container having a container wall surrounding the open top, comprising:

circumferential securing means for securing the lid to the container over the open top of the container;

a central lid portion extending over the open top of the container inside the circumferential securing means;

a raised portion extending above the central lid portion;

a deformable section sloping from the raised portion to the central lid portion and covering an opening in the central lid portion under the deformable section, said deformable section being at least partially separable with respect to the central lid portion, and being deformable toward the raised portion so said deformable section can be deformed and snapped into a stable position against the raised portion thereby uncovering and opening the opening in the central lid portion to allow the contents of the container to be discharged through the opening and to be deformed and snapped back to its original position over the opening to close the opening.

2. A spill resistant lid according to claim 1, wherein the raised portion forms a mouthpiece to aid the user in locating and drinking from the container with the lid thereon.

3. A spill resistant lid according to claim 2, wherein the deformable section extends inwardly and downwardly from the mouthpiece to the central lid portion.

4. A spill resistant lid according to claim 3, wherein the raised portion is a part of a circumferential wall extending above the central lid portion.

5. A spill resistant lid according to claim 4, wherein the circumferential wall, together with the central lid portion, form a reservoir.

6. A spill resistant lid according to claim 5, wherein the deformable section is a cylindrical section.

7. A spill resistant lid according to claim 6, wherein the cylindrical section is separable with respect to the central lid portion along the intersection of the cylindrical section and the central lid portion.

8. A spill resistant lid according to claim 7, wherein a cut separates the cylindrical section from the central lid portion.

9. A spill resistant lid according to claim 8, wherein the cut is provided by a score line.

10. A spill resistant lid according to claim 8, wherein the cut is provided by a line of perforations.

11. A spill resistant lid according to claim 6, wherein the cylindrical section is separable from the central lid portion above the central lid portion and an extension extends between the central lid portion and the cylindrical section.

12. A spill resistant lid according to claim 1, wherein the deformable section is a cylindrical section.

13. A spill resistant lid according to claim 1, wherein the deformable section is separable with respect to the central lid portion along the intersection of the deformable section and the central lid portion.

14. A spill resistant lid according to claim 13, wherein a cut separates the deformable section from the central lid portion.

15. A spill resistant lid according to claim 14, wherein the cut is provided by a score line.

16. A spill resistant lid according to claim 14, wherein the cut is provided by a line of perforations.

17. A spill resistant lid according to claim 1, wherein the deformable section is separable from the central lid portion above the central lid portion and an extension extends between the central lid portion and the deformable section.

* * * * *